United States Patent [19]

Jean et al.

[11] Patent Number: 4,556,368

[45] Date of Patent: Dec. 3, 1985

[54] VAPOR PRESSURE PUMP

[75] Inventors: Benoit Jean, Boucherville; Benoit Bergevin; Fernand Rheault, both of Sainte-Julie, all of Canada

[73] Assignee: Soltrac, Inc., Montreal, Canada

[21] Appl. No.: 577,772

[22] Filed: Feb. 7, 1984

[30] Foreign Application Priority Data

Dec. 2, 1983 [CA] Canada ..... 442469

[51] Int. Cl.[4] ..... F04B 19/24; F04F 1/18

[52] U.S. Cl. ..... 417/208; 219/271; 219/273; 219/275; 122/457

[58] Field of Search ..... 417/52, 207–209, 417/379; 122/457; 219/271, 273, 275, 276; 99/281–283, 288

[56] References Cited

U.S. PATENT DOCUMENTS

| | | | |
|---|---|---|---|
| 96,368 | 11/1869 | Warner | 417/208 |
| 215,639 | 5/1879 | Lawrence et al. | 417/208 |
| 1,712,492 | 5/1929 | Dienner | 417/207 X |
| 2,744,470 | 5/1956 | Coleman | 417/209 |
| 2,969,747 | 1/1961 | MacCracken et al. | 417/209 |
| 3,073,257 | 1/1963 | MacCracken | 417/209 |
| 3,200,763 | 8/1965 | Lippincott | 417/209 |
| 3,285,001 | 11/1966 | Turnblade | 417/208 X |
| 3,793,934 | 2/1974 | Martin | 99/282 |
| 3,972,651 | 8/1976 | Fletcher et al. | 417/379 X |
| 4,143,589 | 3/1979 | Weber | 99/283 X |
| 4,227,489 | 10/1980 | Regamey | 122/457 |
| 4,366,853 | 1/1983 | Bernier | 417/207 X |

FOREIGN PATENT DOCUMENTS

| | | | |
|---|---|---|---|
| 560865 | 7/1958 | Canada | 417/209 |
| 2017227 | 10/1979 | United Kingdom | 417/207 |

*Primary Examiner*—William L. Freeh
*Assistant Examiner*—Paul F. Neils
*Attorney, Agent, or Firm*—Keil & Weinkauf

[57] ABSTRACT

A vapor pressure pump for delivering a liquid into a system operating at a higher pressure or located at a higher level by action of a vapor pressure produced from a portion of the liquid to be delivered. The pump comprises a closed reservoir for liquid, which includes an unidirectional liquid inlet, an unidirectional liquid outlet, a vapor exhaust valve adapted to balance the pressure between the unidirectional liquid inlet and the reservoir during its filling. The pump also comprises a vapor generator for producing vapor inside the reservoir at a pressure sufficient to force out the liquid contained therein through the liquid outlet, and a control device for operating the vapor generator only when the liquid fed by the liquid inlet has reached a predetermined level in the reservoir. According to the invention, the vapor generator comprises an evaporation chamber in vapor communication with the closed reservoir, and a device responsive to the control device for sampling a portion of the liquid contained in the reservoir when the liquid in the reservoir has reached the predetermined value, and for supplying the sampled liquid into the evaporation chamber. The vapor generator also comprises a heating system for evaporating the sampled liquid supplied into the evaporation chamber to produce the pressure vapor required to force the liquid out of the reservoir.

22 Claims, 3 Drawing Figures

VAPOR PRESSURE PUMP

BACKGROUND OF THE INVENTION

The present invention relates to a vapor pressure pump for delivering a liquid into a system operating at a higher pressure or located at a higher level by action of a vapor pressure produced from a portion of the liquid to be delivered.

Many types of vapor pressure pumps have been developed in this particular field. The pressure pumps known and commercialized under the names of "acid egg" or "pulsometer" are examples thereof.

Every pump of this particular type comprises a closed reservoir fed with a liquid under the effect of gravity via an inlet valve. The pump is useful for discharging the liquid in another reservoir having an internal pressure higher than the one of the first reservoir, or being placed above it. When a predetermined level of liquid is reached in the pump, a vapor or gas pressure higher than the pressure to force back, is injected or produced into the reservoir. As a result, the liquid is expelled into an outlet pipe through an exhaust valve.

Injection or production of a gas or vapor pressure in the reservoir may be carried out in two different manners. In the former one, vapor pressure is generated and stocked in a distinct reservoir. When the predetermined level of liquid is reached, an electrical, pneumatic or mechanical mechanism actuates the opening of a floodgate connecting the vapor reservoir to the pump. In the latter one, a float-operated heat source is disposed inside the reservoir to evaporate a portion of the liquid contained therein and raise the vapor pressure at a value sufficient to expel the liquid as soon as the level of the liquid inside the reservoir has reached the predetermined level. Such a "thermodynamic" pump is described by way of example in U.S. Pat. No. 4,227,489 to Regamey, for use in a boiler and heat exchanger system.

BRIEF SUMMARY OF THE INVENTION

The present invention proposes a vapor pressure pump of the above-mentioned type, which pump distinguishes over the known prior art in that it comprises improved means for ensuring cyclic functioning of the pump, control of the heat source and generation of vapor.

More particularly, the invention proposes a vapor pressure pump in which vapor is generated from a small portion of the liquid to be pumped, which portion is sampled from the reservoir only when a predetermined level is reached by the liquid in said reservoir. In order to generate vapor, the sampled liquid is discharged on a surface heated to cause flash evaporation of the liquid. This evaporation creates a sudden rise of pressure that holds as long as necessary to expel the liquid contained in the reservoir.

The portion of the liquid used for the generation of vapor is sampled only when the reservoir of the pump is full. The remaining portion of the liquid to be pumped is never in contact with the hot surface, thus minimizing the energetic comsumption by the pump.

DETAILED DESCRIPTION OF THE INVENTION

The vapor pressure pump according to the invention which is used for delivering a liquid into a system operating at a higher pressure or located at a higher level by action of a vapor pressure produced from a portion of said liquid to be delivered, basically comprises:

a closed reservoir for liquid, which reservoir comprises an unidirectional liquid inlet, an unidirectional liquid outlet, and a vapor exhaust valve adapted to balance the pressure between the unidirectional liquid inlet and the reservoir during its filling;

means for producing vapor inside that reservoir at a pressure sufficient to force out the liquid contained in it through the liquid outlet, and control means for operating the vapor producing means only when the liquid fed by the liquid inlet has reached a predetermined level in the reservoir.

The vapor pressure pump is advantageously characterized in that its vapor producing means comprises:

an evaporation chamber in vapor communication with the closed reservoir;

means responsive to the control means for sampling a portion of the liquid contained in the reservoir when the liquid in the reservoir has reached the predetermined value, and for supplying this sampled liquid into the evaporation chamber; and heating means for evaporating the sampled liquid supplied into the evaporation chamber to produce the vapor pressure required to force the liquid out of the reservoir.

As aforesaid, the pump according to the invention is utilized for delivering a liquid into a system operating at a higher pressure or located at a higher level by action of a vapor pressure produced from a portion of the liquid to be delivered.

More particularly, the pump according to the subject invention may be utilized in a solar heating system or a heat recovery system such as described in U.S. patent application Ser. No. 506,542 filed on June 21, 1983 in the name of the same Applicant.

According to a preferred embodiment of the invention, the evaporation chamber is located inside the closed reservoir. Furthermore, the control means comprises a float and the sampling means comprises a first obturator operated by this float for intermittently opening a liquid discharge aperture provided between the reservoir and the evaporation chamber. This aperture is sized and positioned to let the required portion of liquid flow by gravity from the reservoir to the evaporation chamber to produce the necesssary vapor pressure.

The closed reservoir must be provided with a vapor exhaust valve adapted to balance the pressure between the unidirectional liquid inlet and the reservoir during filling thereof. The vapor exhaust valve includes an aperture and a second obturator which is actuated in counteraction to the actuation of the liquid discharge aperture by the operation of the float.

The first and second obturators are preferably provided at the ends of a vertically extending stem passing through the float. This stem has such a length that the closure of the aperture of the vapor exhaust valve by the second obturator occurs simultaneously with the opening of the discharge aperture by the first obturator, and vice versa. These first and second obturators consist of seat-engaging surfaces.

Advantageously, the evaporation chamber is defined between the inner wall of the closed reservoir and the outer wall of another reservoir located inside the closed reservoir in coaxial position with respect thereto.

The upper part of the other reservoir is open so as to facilitate the gravity outflow of liquid in it. The other reservoir may be supported by a few contacting points at the bottom of the closed reservoir.

Moreover, the liquid discharge aperture is provided at the bottom of the other reservoir whereby the accumulated condensed liquid may escape and fill up the volume between the walls of the coaxial reservoirs.

The closed reservoir may be made of a heat-conductive material such as metal, while the other reservoir is made of a heat-insulating material, to reduce thermal exchanges between the hot wall of the closed reservoir and the wall of the other reservoir. This arrangement allows an effective functioning of the pump without heat loss during the heating of the liquid to be pumped.

The float may be made of a heat-insulating material for thermally insulating the liquid surface in the other reservoir.

The heating means of the pump may consist of a continuously operating heating sleeve extending all around the outer wall of the closed reservoir. This heating sleeve may be controlled by a thermostat. The said closed reservoir is therefore constantly maintained at a temperature sufficiently high to cause flash evaporation of the liquid discharged between the outer wall of the other reservoir and the inner wall of the closed reservoir.

The pump has no moving parts, except for the valves and float.

Thermal efficiency is a very important feature in solar heating systems or heat recovery systems at low temperature. The existing pumps do not take into account that a good functioning of the pump is achieved only when the heat transfer vapor condensation is reduced to the minimum. It is thus further necessary to reduce the surface of liquid by means of an insulating float as well as the thermal conductivity of the wall of said other reservoir. If these conditions are not met, the vapor condensation generated on the surface of liquid which is cooler, and on the reservoir surface, would delay the rising of pressure inside the pump until the internal medium, including the liquid to be pumped, is elevated at the saturation temperature corresponding to the pumping pressure. As a result, the cycle duration would be unduly prolonged and the energy required for pumping would be increased.

In order to obtain the vapor necessary to create the pressure inside the reservoir when filled up, a small portion of the liquid contained in the other reservoir is brought to escape therefrom and to come into contact with the hot internal wall of the closed reservoir so as to suddenly vaporize. To this end, the bottom of the other reservoir may be provided with a small aperture which is kept closed by means of a first obturator as long as the latter is not raised by the float when it reaches the upper extremity of the reservoir. When the obturator is raised by the float, the liquid is discharged through the aperture and flows out by gravity on the hot wall where it is instantaneously vaporized. The obturator remains in an upward position as long as the float does not lower it when it has reached the lower part of the reservoir. The liquid escapes from the other reservoir as long as it is enclosed therein thus causing maintenance of pressure sufficient to expel the liquid from the reservoir in the outlet pipe through the liquid exhaust valve.

As aforesaid, for obtaining at a given time the vapor necessary to create the pressure inside the pump, the existing systems have resort either to the injection of a vapor under pressure contained in another reservoir, or to the opening of a heat feeding circuit immersed in the liquid to be pumped or in a portion of said liquid. The first system is unfavourable since the permanent maintenance of a vapor or gas reservoir at a desired pressure is necessary. The second system cannot be actuated unless the power of the heat source so utilized is sufficient to overcome the lowering of the pressure caused by the vapor condensation on the cool walls of the reservoir and on the open liquid surface as well as being sufficient to create and maintain the pressure required for expelling the liquid. Since no vaporization must take place in the reservoir before all the liquid has penetrated it, in fact any premature elevation of pressure would prevent its inlet, the starting of the heat source must wait for the almost filling up of the pump. This operation is generally actuated by means of a float, which at a certain predetermined level, switches on the heat source, thus creating delays or necessitating a higher power heat source.

In the pump according to the subject invention, the heat source preferably works out continuously to maintain, by means of a thermostat, the temperature of the closed reservoir lower than a maximum value for preventing overheat. Its functioning is only indirectly related to that of the pump. In accordance with the invention, vapor is generated only at a given time when the reservoir of the pump is full; the production of vapor is obtained instantaneously without waiting for the temperature equilibrium, and the elevation of pressure in the closed reservoir of the pump is achieved instantaneously to maintain in a closed position the vapor exhaust valve and the inlet liquid valve.

The upward and downward motion of the obturators is simple and tolerances of manufacture and positioning are easy to achieve. It further ensures a self-regulating mechanism without any external intervention. This utilization of a closed metallic reservoir having a high thermal capacity promotes the maintenance of vaporization, thus of pressure, neither suffering the drawbacks of a lowering of temperature, nor having resort to a heat source with a high power.

The power required for working out such a pump is reduced to the minimum, so that it becomes an important factor when the pump is connected to a solar energy or thermal waste products recovery system at low temperature.

According to another preferred embodiment of the invention, the pump may be provided with other liquid control mechanisms having the same effect. Use can be made, for example, of a self-priming siphon positioned inside the closed reservoir in such a manner that it becomes operative when the level of the liquid in said reservoir has reached its predetermined value.

The siphon has the same function as the aperture of the bottom of said other reservoir, i.e. it allows the sampled liquid to be vaporized and it ensures the draining of said liquid as long as said other reservoir is not empty.

The float keeps its function of thermal insulator of the liquid surface in the reservoir as well as its function of actuating mechanism of the obturator of the vapor exhaust valve. Said valve operates in counteraction to the actuation of the siphon by means of the obturator operated by the float. Said obturator is provided at one end of a vertically extending stem passing through the float. This obturator consists of a seat-engaging surface.

As for the first embodiment, the evaporation chamber is advantageously defined between the inner wall of the closed reservoir and the outer wall of another reservoir located inside the closed reservoir in coaxial position with respect thereto.

The other components of this pump are similar to those defined above for the first form of embodiment of the subject invention.

An improved functioning of the pump according to the subject invention is achieved when the following conditions are met:

(1) The hot surface is at such an elevated temperature and has such a high thermal inertia that the evaporated liquid produces and maintains the pressure necessary for discharging the liquid.

(2) The surfaces in contact with the liquid to be pumped have a low thermal conductivity to avoid any further condensation of vapor on walls cooled by the said liquid, and any elevation of temperature; if this characteristic is not satisfied, a lowering of pressure inside the pump as well as a needless reheat of the liquid may occur.

(3) The quantity and flow of the sampled liquid are sufficient to generate and maintain a pressure corresponding to the height of the column or pressure to overcome, during all the emptying of the pump.

(4) The surface of liquid in contact with vapor is reduced to the minimum and insulated for avoiding any further condensation of vapor.

(5) The means for sampling the liquid to be vaporized, for opening and closing the valves and the vapor exhaust valve are passive, i.e. subjected to the rise of the level of liquid as well as to the internal pressure of the pump without interference of any external electrical or mechanical control elements.

The invention and its advantages will be better understood upon reading of the following non restrictive description of two preferred embodiments thereof, made with reference to the accompanying drawings.

FIGS. 1 and 2 are cross-sectional views of two embodiments of the pump according to the invention.

FIG. 3 is a cross-sectional view of a further embodiment of the subject pump.

BRIEF DESCRIPTION OF THE DRAWINGS

The pump shown in FIG. 1, comprises a tightly closed reservoir (1) and another reservoir (2) located inside the closed reservoir (1) in coaxial position with respect thereto.

The reservoir (2) is slightly separated from the reservoir (1) to define between their walls a small available space called an evaporation chamber (3). The closed reservoir (1) is made of a heat-conductive material and is heated by means of an external heat source (4). The other reservoir (2), which is made of an insulating material, is completely open on top and has a small aperture (5) at the bottom. An insulating float (14) is enclosed with the other reservoir (2).

Figure 1:
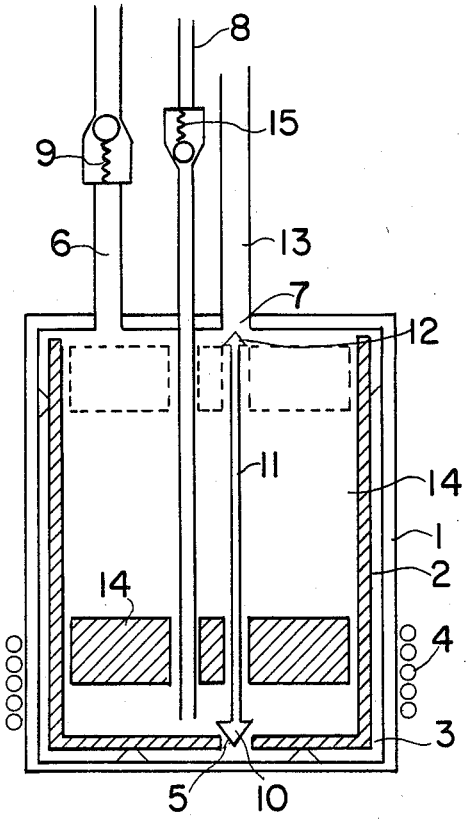

The pump also comprises a condensed liquid inlet pipe (6), a vapor exhaust valve (7) for balancing the pressure between the pump and the remaining part of the system, and a liquid exhaust pipe (8).

The functioning steps of this pump will now be described.

When the reservoir (2) is empty and the pressures are balanced, the liquid to be pumped is discharged by gravity in the reservoir (2) through pipe (6) via the oneway valve (9) lowered by means of the pressure of the column of liquid in said pipe (6). In order to avoid that the liquid discharged in reservoir (2) enters evaporation chamber (3) and comes into contact with the hot wall of the closed reservoir (1), a first obturator (10) closes the aperture (5) at the bottom of the reservoir (2). This first obturator (10) is operated by the float (14). Said first obturator (10) is mechanically interconnected to a second obturator (12) which is a component of vapor exhaust valve (7), each obturator being provided at the ends of a rigid stem (11). Said stem (11) has such a length that the closure of the aperture of the vapor exhaust valve (7) by the second obturator (12) occurs simultaneously with the opening of the discharge aperture (5) by the first obturator (10), and vice versa. The vapor exhaust valve (7) is connected to a vapor exhaust pipe (13) through which vapor may escape when the valve (7) is opened. Such an opening allows one to balance the pressure inside the closed reservoir (1) with the pressure over the liquid to be delivered by gravity into the reservoir (2) through the inlet pipe (6). As the reservoir (2) is filled up, the float (14) made of insulating material, which initially was leaning against the base of the first obturator (10), raises. When it reaches the base of the second obturator (12), it lifts it to close the aperture of the vapor exhaust valve (7). As a result, the aperture (5) at the bottom of the reservoir (2) is freed, which enables the discharge of liquid in the evaporation chamber (3).

The outer wall of the closed reservoir (1) being maintained hot by means of the continuously operating heating sleeve (4) extending all around it, when in contact therewith, the liquid which escapes through the aperture (5) instantaneously evaporates so as to create a sudden elevation of pressure into the pump. The inlet valve (9) therefore closes and the liquid exhaust valve (15) opens to expel the liquid accumulated in the reservoir (2) through pipe (8). As the liquid level lowers, the pressure kept elevated by the discharge of the liquid through the aperture (5) maintains closed the aperture of the vapor exhaust valve (7). When the reservoir (2) is empty, the weight of the float (14) leans against the lower obturator (10) which closes the aperture (5) at the bottom and which forces the upper obturator (12), held in position by the internal pressure, to free the aperture of the vapor exhaust valve (7). The pressure being balanced between a given system and the pump, the valve (9) opens again to let the liquid fill up the reservoir (2). The cycle therefore repeats itself.

Figure 2:
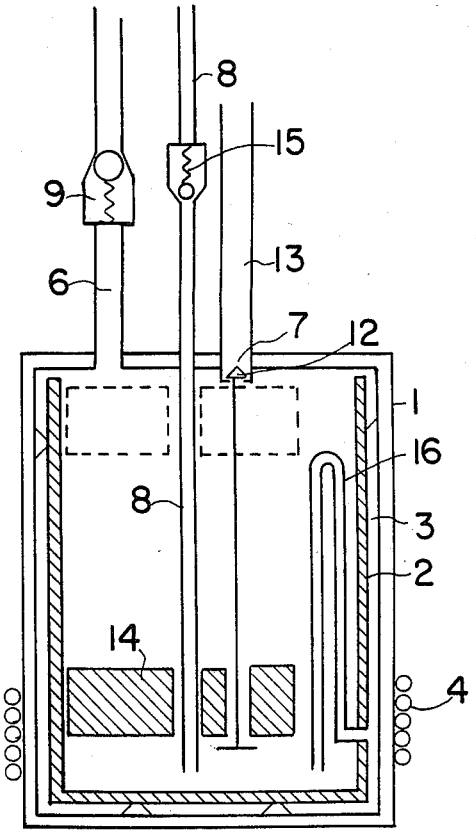

According to another embodiment of the invention shown in FIG. 2, the discharge of liquid in the evaporation chamber (3) is carried out by means of a self-priming siphon (16), positioned inside the other reservoir (2) in such a manner that it becomes operative when the level of the liquid in said reservoir (2) has reached its predetermined value. Said siphon (16) has the same function as the aperture (5) (cf. FIG. 1) at the bottom of the other reservoir (2).

As for the first embodiment, the float (14) actuates the mechanism of the obturator (12) of the vapor exhaust valve (7). Said valve (7) operates in counteraction to the actuation of the siphon (16). The obturator (12) is provided at one end of a vertically extending stem (11) passing through the float (14).

Figure 3:
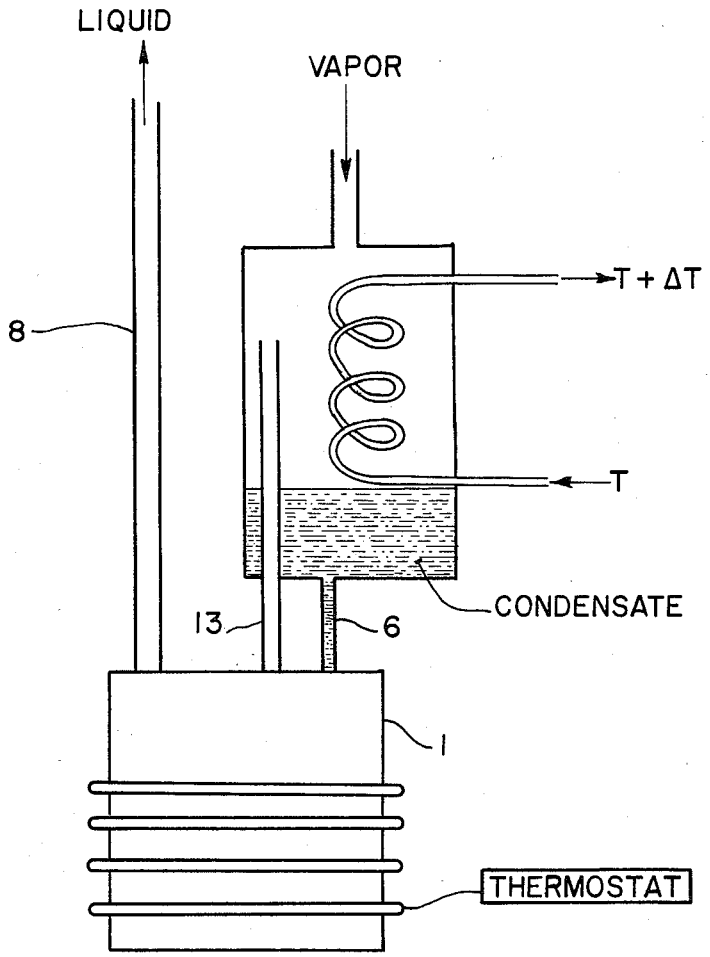

In FIG. 3, a thermostat is shown associated with the heating sleeve surrounding reservoir 1. Condensate is collected in the heat exchanger which is equipped with heating coils.

We claim:

1. A vapor pressure pump for delivering a liquid into a system operating at a higher pressure or located at a higher level by action of a vapor pressure produced from a portion of said liquid to be delivered, said pump comprising:

an outer closed reservoir provided with an unidirectional liquid inlet through which a liquid may flow by gravity, an unidirectional liquid outlet and a vapor exhaust valve adapted to balance the pressure between the unidirectional liquid inlet and the outer reservoir;

an inner, upwardly opened reservoir located inside the closed reservoir for receiving the liquid entering the closed reservoir through the liquid inlet, said inner reservoir being in liquid communication with the liquid outlet;

means for producing vapor inside the outer reservoir at a pressure sufficient to force out the liquid contained in said inner reservoir through the liquid outlet, said vapor producing means comprising an evaporation chamber in vapor communication with said closed reservoir, said evaporation chamber being defined between the walls of said inner and outer reservoirs;

control means for operating said vapor producing means only when the liquid fed by the liquid inlet has reached a predetermined level into the inner reservoir;

means responsive to said control means for sampling a portion of the liquid contained in the inner reservoir when said liquid in said inner reservoir has reached the predetermined level, and for supplying said sampled liquid into said evaporation chamber; and heating means for evaporating said sampled liquid supplied to the evaporation chamber to produce the vapor pressure required to force the liquid out of the reservoir.

2. The vapor pressure pump of claim 1, wherein said control means comprises a float and said sampling means comprises a first obturator operated by said float for intermittently opening a liquid discharge aperture provided in a wall of said inner reservoir, said aperture being sized and positioned to allow a portion of the liquid to escape by gravity from said inner reservoir to said evaporation chamber to produce the necessary vapor pressure.

3. The vapor pressure pump of claim 2, wherein the liquid to be pumped is a condensed vapor collected at the bottom of a heat exchanger.

4. The vapor pressure pump of claim 2, wherein said vapor exhaust valve includes an aperture and a second obturator which is actuated in counteraction to the actuation of the liquid discharge aperture by the operation of said float.

5. The vapor pressure pump of claim 4, wherein said first and second obturators are provided at the ends of a vertically extending stem passing through the float, said stem having such a length that the closure of the aperture of the vapor exhaust valve by the second obturator occurs simultaneously with the opening of the discharge aperture by the first obturator, and vice versa.

6. The vapor pressure pump of claim 5, wherein said first and second obturators each consist of a seat-engaging surface.

7. The vapor pressure pump of claim 2, wherein the inner reservoir is located inside the closed reservoir in coaxial position with respect thereto.

8. The vapor pressure pump of claim 7, wherein said liquid discharge aperture is provided at the bottom wall of said inner reservoir.

9. The vapor pressure pump of claim 8, wherein said closed reservoir is made of a heat-conductive material and said other reservoir is made of a heat-insulating material.

10. The vapor pressure pump of claim 9, wherein said float is made of a heat-insulating material for thermally insulating the liquid surface in said inner reservoir.

11. The vapor pressure pump of claim 8, wherein said heating means consists of a continuously operating sleeve extending all around the outer wall of said closed reservoir.

12. The vapor pressure pump of claim 11, wherein said heating sleeve is controlled by a thermostat.

13. The vapor pressure pump of claim 1, wherein said control means comprises a self-priming siphon positioned between the inner reservoir and the evaporation chamber in such a manner that it becomes operative when the level of the liquid in said inner reservoir has reached its predetermined level.

14. The vapor pressure pump of claim 13, wherein the liquid to be pumped is a condensed vapor collected at the bottom of a heat exchanger.

15. The vapor pressure pump of claim 13, wherein said vapor exhaust valve includes an aperture and an obturator which is actuated in counteraction to the actuation of the siphon by the operation of a float.

16. The vapor pressure pump of claim 15, wherein said obturator is provided at one end of a vertically extending stem passing through the float.

17. The vapor pressure pump of claim 16, wherein said obturator consists of a seat-engaging surface.

18. The vapor pressure pump of claim 15, wherein said inner reservoir is located inside the closed reservoir in coaxial position with respect thereto.

19. The vapor pressure pump of claim 18, wherein said closed reservoir is made of a heat-conductive material and said other reservoir is made of a heat-insulating material.

20. The vapor pressure pump of claim 19, wherein said float is made of a heat-insulating material for thermally insulating the liquid surface in said inner reservoir.

21. The vapor pressure pump of claim 20, wherein said heating means consists of a continuously operating heating sleeve extending all around the outer wall of said closed reservoir.

22. The vapor pressure pump of claim 21, wherein said heating sleeve is controlled by a thermostat.

* * * * *